US008061890B2

(12) United States Patent
Suhner

(10) Patent No.: US 8,061,890 B2
(45) Date of Patent: Nov. 22, 2011

(54) STATIC MIXER

(75) Inventor: Marcel Suhner, Wiesendangen (CH)

(73) Assignee: Sulzer Chemtech AG, Winterthur (CH)

( * ) Notice: Subject to any disclaimer, the term of this patent is extended or adjusted under 35 U.S.C. 154(b) by 556 days.

(21) Appl. No.: 11/801,551

(22) Filed: May 10, 2007

(65) Prior Publication Data

US 2007/0263486 A1 Nov. 15, 2007

(30) Foreign Application Priority Data

May 15, 2006 (EP) ..... 06113920

(51) Int. Cl.
*B01F 5/06* (2006.01)

(52) U.S. Cl. ..... 366/337; 138/42

(58) Field of Classification Search ..... 138/39, 138/42; 366/336, 337; 239/398, 416.5, 434.5; 52/783.16

See application file for complete search history.

(56) References Cited

U.S. PATENT DOCUMENTS

| | | | | | |
|---|---|---|---|---|---|
| 574,157 | A | * | 12/1896 | Ljungstrom | 165/166 |
| 772,279 | A | * | 10/1904 | Grouvelle et al. | 165/177 |
| 778,301 | A | * | 12/1904 | Burdick | 366/184 |
| 846,751 | A | * | 3/1907 | Melvin | 366/9 |
| 1,095,555 | A | * | 5/1914 | Crone | 392/488 |
| 1,224,656 | A | * | 5/1917 | McCandless | 366/9 |
| 1,496,896 | A | * | 6/1924 | Laffoon | 366/337 |
| 2,132,961 | A | * | 10/1938 | Morgan | 209/139.1 |
| 2,136,086 | A | * | 11/1938 | Rosenblad | 165/166 |
| 2,321,110 | A | * | 6/1943 | Shipman | 165/160 |
| 2,396,208 | A | * | 3/1946 | Serre et al. | 181/259 |
| 2,455,572 | A | * | 12/1948 | Evans | 366/336 |
| 2,684,690 | A | * | 7/1954 | Lee | 137/601.08 |
| 3,013,781 | A | * | 12/1961 | Haselden | 261/112.2 |
| 3,075,559 | A | * | 1/1963 | Sharp et al. | 406/191 |
| 3,275,304 | A | * | 9/1966 | Brundrett | 366/337 |
| 3,373,562 | A | * | 3/1968 | Wormser | 60/745 |
| 3,423,076 | A | * | 1/1969 | Hermsen et al. | 366/337 |
| 3,466,151 | A | * | 9/1969 | Daumard et al. | 422/191 |
| 3,532,161 | A | * | 10/1970 | Loebel | 165/167 |
| 3,540,702 | A | * | 11/1970 | Uyama | 261/112.2 |
| 3,593,964 | A | * | 7/1971 | Morane | 366/340 |
| 3,599,943 | A | * | 8/1971 | Munters | 261/95 |
| 3,645,298 | A | * | 2/1972 | Roberts et al. | 138/40 |
| 3,682,443 | A | * | 8/1972 | Upmeier | 366/336 |
| 3,785,620 | A | * | 1/1974 | Huber | 366/175.2 |
| 3,841,568 | A | * | 10/1974 | Broad | 239/590 |
| 3,871,624 | A | * | 3/1975 | Huber et al. | 366/336 |
| 3,887,739 | A | * | 6/1975 | Kromrey | 428/112 |

(Continued)

FOREIGN PATENT DOCUMENTS

| | | |
|---|---|---|
| DE | 1171397 | 6/1964 |

(Continued)

*Primary Examiner* — David Sorkin

(74) *Attorney, Agent, or Firm* — Francis C. Hood; Carella, Byrne, Cecchi

(57) ABSTRACT

A mixing element is constructed for installation in a fluid-conducting conduit having an inlet opening of a first cross-section and an outlet opening of a larger second cross-section which is arranged in a plane disposed substantially normal to the main direction of flow. The mixing element has a cross-sectional design which increases substantially continuously from the first cross-section to the second cross-section. Flow-dividing layers are arranged in the mixing element such that a precise fitting of the mixing element into the substantially continuously expanding fluid-conducting means is made possible.

11 Claims, 11 Drawing Sheets

U.S. PATENT DOCUMENTS

| | | | | | |
|---|---|---|---|---|---|
| 3,893,509 | A | * | 7/1975 | Satchwell et al. | 165/166 |
| 3,902,850 | A | * | 9/1975 | Lehnert | 422/133 |
| 3,907,708 | A | * | 9/1975 | Lacroix | 502/221 |
| 3,918,688 | A | * | 11/1975 | Huber et al. | 366/336 |
| 3,936,382 | A | * | 2/1976 | White | 210/198.1 |
| 3,953,176 | A | * | 4/1976 | Santala et al. | 422/171 |
| 3,977,657 | A | * | 8/1976 | Shearer et al. | 366/341 |
| 4,007,908 | A | * | 2/1977 | Smagghe et al. | 251/127 |
| 4,178,991 | A | * | 12/1979 | Bieri | 165/166 |
| 4,181,509 | A | * | 1/1980 | Honacker et al. | 96/18 |
| 4,185,780 | A | * | 1/1980 | Duchene et al. | 239/553.5 |
| 4,372,734 | A | * | 2/1983 | Dolan et al. | 425/131.1 |
| 4,385,840 | A | * | 5/1983 | Wisneski | 366/336 |
| 4,418,722 | A | * | 12/1983 | Kendall et al. | 138/42 |
| 4,470,455 | A | * | 9/1984 | Sacca | 165/167 |
| 4,497,751 | A | * | 2/1985 | Pluss | 261/94 |
| 4,513,807 | A | * | 4/1985 | Rose et al. | 165/10 |
| 4,598,063 | A | * | 7/1986 | Retallick | 502/439 |
| 4,693,450 | A | * | 9/1987 | Paetzel | 251/121 |
| 4,731,229 | A | * | 3/1988 | Sperandio | 422/188 |
| 4,793,247 | A | * | 12/1988 | Verweij | 366/338 |
| 4,813,788 | A | * | 3/1989 | Shih et al. | 366/337 |
| 4,869,594 | A | * | 9/1989 | Mahoney, Jr. | 366/341 |
| 4,902,418 | A | * | 2/1990 | Ziegler | 210/321.77 |
| 5,005,983 | A | * | 4/1991 | Draffen et al. | 366/340 |
| 5,099,879 | A | * | 3/1992 | Baird | 137/561 A |
| 5,103,641 | A | * | 4/1992 | Maus et al. | 60/299 |
| 5,150,573 | A | * | 9/1992 | Maus et al. | 60/299 |
| 5,157,010 | A | * | 10/1992 | Maus et al. | 502/439 |
| 5,174,370 | A | * | 12/1992 | Hallgren | 165/166 |
| 5,226,474 | A | * | 7/1993 | Hallgren | 165/110 |
| 5,248,197 | A | * | 9/1993 | Storf et al. | 366/341 |
| 5,301,747 | A | * | 4/1994 | Daschmann et al. | 165/166 |
| 5,380,088 | A | * | 1/1995 | Fleischli et al. | 366/162.1 |
| 5,407,274 | A | * | 4/1995 | Woerheide et al. | 366/337 |
| 5,506,028 | A | * | 4/1996 | Bruck | 428/116 |
| 5,529,084 | A | * | 6/1996 | Mutsakis et al. | 137/13 |
| 5,531,484 | A | * | 7/1996 | Kawano | 285/179.2 |
| 5,531,831 | A | * | 7/1996 | Sweeney et al. | 118/600 |
| 5,535,175 | A | * | 7/1996 | Niimi | 366/336 |
| 5,772,178 | A | * | 6/1998 | Bey | 251/127 |
| 5,937,908 | A | * | 8/1999 | Inoshiri et al. | 138/39 |
| 5,997,173 | A | * | 12/1999 | Ingram et al. | 366/337 |
| 6,089,549 | A | * | 7/2000 | Ingram et al. | 261/94 |
| 6,155,338 | A | * | 12/2000 | Endou et al. | 165/165 |
| 6,186,223 | B1 | * | 2/2001 | Bergh et al. | 165/165 |
| 6,190,784 | B1 | * | 2/2001 | Maus et al. | 428/593 |
| 6,192,975 | B1 | * | 2/2001 | Yanai et al. | 165/165 |
| 6,321,998 | B1 | * | 11/2001 | Schubert et al. | 239/8 |
| 6,358,415 | B1 | * | 3/2002 | Leung | 210/205 |
| 6,409,378 | B1 | * | 6/2002 | Kessler | 366/337 |
| 6,575,617 | B2 | * | 6/2003 | Fleischli et al. | 366/337 |
| 6,613,446 | B1 | * | 9/2003 | Peters et al. | 428/593 |
| 6,878,400 | B2 | * | 4/2005 | Colombo et al. | 427/212 |
| 7,089,963 | B2 | * | 8/2006 | Meheen | 138/44 |
| 7,114,638 | B2 | * | 10/2006 | Vaynshteyn et al. | 222/181.1 |
| 7,237,943 | B2 | * | 7/2007 | Brown | 366/303 |
| 7,316,503 | B2 | * | 1/2008 | Mathys et al. | 366/337 |
| 7,713,322 | B2 | * | 5/2010 | Wieres et al. | 55/482 |
| 7,799,734 | B2 | * | 9/2010 | Maus et al. | 502/439 |
| 2001/0026876 | A1 | * | 10/2001 | Kessler | 428/615 |
| 2002/0048213 | A1 | * | 4/2002 | Wilmer et al. | 366/136 |
| 2002/0108368 | A1 | * | 8/2002 | Hodgson | 60/286 |
| 2004/0037161 | A1 | * | 2/2004 | Honda et al. | 366/176.1 |
| 2004/0052156 | A1 | * | 3/2004 | Brown | 366/286 |
| 2004/0061001 | A1 | * | 4/2004 | Mao et al. | 239/398 |
| 2004/0223408 | A1 | * | 11/2004 | Mathys et al. | 366/337 |
| 2005/0263199 | A1 | * | 12/2005 | Meheen | 138/44 |

FOREIGN PATENT DOCUMENTS

| | | | | |
|---|---|---|---|---|
| DE | 3229486 | A1 | * | 2/1984 |
| DE | 3719773 | A1 | * | 12/1988 |
| DE | 3923094 | A1 | * | 1/1991 |
| DE | 4104637 | A1 | * | 8/1991 |
| EP | 0794325 | | | 9/1997 |
| EP | 0918146 | | | 5/1999 |
| GB | 2073604 | | | 10/1981 |
| JP | 55049133 | A | * | 4/1980 |
| JP | 3-169348 | | | 7/1991 |
| JP | 8-312339 | | | 11/1996 |
| RU | 2 239 491 | C1 | | 11/2004 |

* cited by examiner

STATIC MIXER

This invention relates to a mixing element for a static mixer.

As is known, static mixers are used for the mixing of two or more fluid components, in particular of gas-liquid mixtures. The mixing element should in particular be used in a fluid-conducting means made as a diffuser section. The mixing element contributes at least to the maintenance of a uniform mixing state in the diffuser in that the mixing element counters any demixing effects by its constructive design and/or effects a uniform mixture of the components flowing through the diffuser section. The static mixer thus includes the fluid-conducting means with an inlet opening for the components of a first diameter and an outlet opening for the mixture of a second diameter, with the fluid-conducting means having a diameter development which increases substantially continuously from the first diameter to the second diameter as well as a mixing element arranged in the diffuser section. The fluid-conducting means can in particular be made as a substantially continuously expanding line piece.

It is known from the prior art in accordance with EP-A-918146 to provide installations in a mixer housing that expand as a diffuser. These installations are formed from concentric jacket surfaces of frustoconical shape. The cone tips are disposed at least approximately on one point and the entry cross-sections of the installations each form a surface with their edges which has a shape tapering against the flow direction. Gases flowing through the diffuser, pollutants in the case of EP-A 918146, are directed more uniformly into a downstream catalyst by the installations.

In the device for the reduction of pollutants in accordance with EP-A-918146, so-called marginal effects, which are also called channelling, occur on the passage of the gases. These marginal effects are caused by marginal flows by which a slowing down of the flow results relative to the center. These marginal flows mainly arise through friction effects at the inner wall of the diffuser. On the widening in the cone, a reduction in the speed can occur in the region close to the wall due to the braking effect caused by the aforesaid frictional effects, which can even have the result that the respective drop-like or bubble-like phase, i.e. the disperse phase, in particular liquid components, can no longer hold themselves in suspension with the continuous phase, in particular a gas, and separate.

Gas-liquid mixtures of this type are used, for example, as coolants in the processing of LNG (liquid natural gas). This coolant consists of different gaseous and liquid components, with the portion in particular including very volatile aliphatic hydrocarbons, preferably methane, ethane, propane and/or butane. For the cooling, the coolant is introduced into a heat exchanger which is generally designed as a tube bundle heat exchanger. The heat exchanger is designed for a cooling capacity which requires a homogeneous coolant mixture; otherwise the cooling capacity cannot be used to the optimum. If a separation of the cooling mixture accordingly occurs, the desired cooling capacity can possibly no longer be reached and the required capacities cannot be maintained. It was previously therefore necessary to make the heat exchanger correspondingly over-dimensioned.

It was accepted as fact that conventional static mixers could not be adapted to a substantially continuously expanding line piece. This belief stood in the way of the solution of the problem with static mixers.

A solution has been offered of using a static mixer of two cylindrical mixing elements, with one of these mixing elements respectively having the diameter of the supply line, that is of a pipe, and the second mixing element having the diameter of the heat exchanger inlet. Measurements on a static mixer of this type have shown that the gaseous and liquid components are not uniformly distributed in this case either. The mixing distance is dimensioned too short for this purpose; in addition, with this mixer arrangement, there is an abrupt transition at the point at which the cylindrical mixing element with the diameter of the supply line is adjacent to the mixing element with the diameter of the heat exchanger inlet. In the present case, the two mixing elements are preferably made in the same length so that the transition lies at the center.

It is the object of the invention to provide a mixing element for a static mixer by means of which a multiphase fluid flow, in particular a gas flow charged with liquid droplets or a liquid flow charged with gas bubbles, can be mixingly conveyed through a substantially continuously expanding line piece while maintaining a uniform distribution of the fluids.

Briefly, the invention provides a mixing element for installation into a fluid-conducting means that includes an inlet opening for at least two components having a first cross-section which is arranged in a plane disposed substantially normal to the main direction of flow in the inlet opening and an outlet opening for a mixture having a second cross-section which is arranged in a plane disposed substantially normal to the main direction of flow in the outlet opening. In accordance with the invention, the mixing element has a cross-sectional development which increases substantially continuously from the first cross-section to the second cross-section and is characterised in that flow-dividing layers are arranged in the mixing element such that a precise fitting of the mixing element into the substantially continuously expanding fluid-conducting means is made possible.

The fluid-conducting means can, in particular, be made as a housing or as a container jacket.

The mixing element is provided, at least partly in the region between the inlet opening and the outlet opening of the fluid-conducting means. This is achieved by the precise fitting that marginal flows are deflected from the inner wall of the fluid-conducting means in the direction of the main flow and are guided together with the main flow through the diffuser with at least approximately the same speed distribution via the observed flow cross-section and fluid of higher flow speed flows as a balance flow from a central region of the cross-section in the direction of the wall region, whereby cross-mixing occurs and consequently an improvement in the mixing of the fluid components.

The flow-dividing layers include flow passages which are in particular made in the manner of a diffuser, advantageously with openly crossing flow passages such as are disclosed, for example, in CH 547 120. Installation elements or layers are provided at least over a part of the cross-section in a mixing element of this type and the components can be guided by them such that shear flows can be generated by crossing flow paths so that continuous eddies arise on superimposition of the flows whereby a continuous mixing of the mixture as well as a simultaneous flow in the direction of the mixer outlet can be achieved.

In an advantageous embodiment, a mixing element includes at least two layers of a thin-walled material. In the simplest case, a layer of this type can be made up of planar, thin-walled metal sheets which are fitted in the expanding cross-section of the fluid-conducting means such that the individual layers in each cross-section appear as sectional surfaces parallel to one another, but the spacing of the sectional surfaces of the layers increases continuously in the direction of flow. Expanding, planar layers of this type are held in position by a framework of fastening means fitted with clamping ties or plug connectors. There is a fastening possibility for each of the layers at least in the region of the inlet cross-section, that is of the inlet opening of the static mixer and in the region of the outlet cross-section, that is the outlet opening of the static mixer. The area formed between two adjacent layers and the fluid-conducting means, which is disposed substantially normally to the main direction of flow, therefore increases in the manner of a diffuser. The mixture flowing between the individual layers then substantially flows through a narrow passage which expands in accordance with the cross-sectional increase of the mixer.

A layer of this type can include a folded structure which can be unwound in one plane and is made of a thin-walled plate material, with the folding in particular being able to be made as ribs. A layer can include structures forming open passages; in particular folded, wave-shaped or jagged-like structures can be provided. Alternatively or in combination therewith, structures forming closed passages can be used such as in particular honeycomb-like or tubular structures. At least one layer can in particular include at least one flow passage. The structures consist of a metallic material; advantageously sheet metal and/or a steel and/or a steel alloy can be used, which is not least dependent on the temperature, the pressure and/or on the nature of the flowing medium. Steels resistant to high temperatures can also be used if the temperature of the medium to be transported requires. The transporting and mixing of corrosive mixtures requires the use of corrosion-resistant materials, in particular corrosion-resistant steels, but also ceramic materials, silicon compounds, carbon and/or coatings including PTFE, epoxy, halar, TNi alloys and/or carbide layers and/or galvanic coatings, in particular coatings applied by chromium plating or nickel plating. If the mixture also contains solid portions such as dust, high demands are made on the scratch-resistance of the installations of the mixing elements. The service life of the static mixer is increased with a scratch-resistant coating of the layers of the mixing element and/or of the fluid-conducting means. In individual cases, the attachment of a dirt-repellent layer can also be advantageous.

For an application in cooling or refrigerating plants, the static mixer is made of material 304 L and/or in SS 316, and/or 904 L, and/or duplex and/or 1.4878, which are characterised by low distortion, corrosion-resistance and cold-suitability at low temperatures. Plastics are used for static mixers which are not subject to high temperature exposure, in particular polypropylene, PVDF or polyethylene.

A further application of a mixing element can be provided in a static mixer in which a chemical reaction can occur. A fast and uniform mixing of the fluid components to be brought into contact with one another should be brought about for the carrying out of a chemical reaction. It is possible for this purpose either to manufacture the layers conducting the flow themselves of a catalyst material or to apply a catalyst material to the layers which preferably consist of a non-penetrated material such as a sheet metal or of a fabric or knitted fabric or an at least partly porous material. In a further application, a layer which can be made in accordance with one of the preceding embodiments can include means for the deposition of microorganisms, in particular bacteria.

In accordance with a further embodiment, a static mixer is fitted with fluid-conducting means having jacket surfaces which are planar in sections, in particular having rectangular or square cross-sectional surfaces which form trapezoidal jacket surfaces which produce the fluid-conducting means in their totality. A static mixer of this type includes at least one mixer element in accordance with one of the preceding embodiments.

At least one layer of the mixing element includes a surface-enlarging structure, in particular a flow passage. In the following text, a layer having a zig-zag section is used as representative of a layer having a surface-enlarging structure. Surface-enlarging structures of this type include wave-like sections, ribbed sections, sections with projections of any desired geometry and/or angular position with respect to the flow direction. A zig-zag section consists of a series of edges when observed with the direction of view on the cross-sectional surface of the passage structure. Each of these edges forms a line in the three-directional layer in the mixing element from the starting cross-section up to the end cross-section. In the simplest case, the line is a straight line; it can, however, have any desired curve shape, in particular a periodically repeating curve shape. A layer of this type having edges with a curved shape can be used, for example, in a mixing element for a fluid-conducting means having a change of the direction of the main flow by which a change in direction of the flowing mixture results in addition to the expanding of the flow cross-section.

With a layer having a symmetrical section such as a zig-zag section, an open passage is disposed between two adjacent edges and its walls are formed by at least two sectional surfaces which are planar and/or follow the curvature of the edges. In this application, the passage has a V-shaped cross-section since the lower boundary of the passage is likewise formed by an edge facing in the opposite direction. In this embodiment, adjacent sectional surfaces are thus arranged at an acute angle to one another which is less than 180°.

In accordance with an embodiment, the edges of adjacent layers come to lie on one another in linear form so that two adjacent. layers having edges facing in opposite directions come to lie on one another. Closed passages are then formed between the two adjacent layers through which the flowing mixture is guided. According to this embodiment, the components of the mixture remain in the same passage, which expands like a diffuser in accordance with the expansion of the fluid-conducting means in the main direction of flow, from the inlet opening into the mixer up to the outlet opening. The spacing of two adjacent layers increases from the cross-section of the inlet opening to the cross-section of the outlet opening, according to the expansion of the fluid-conducting means perpendicular to the main direction of flow. Each layer can be manufactured from a planar plate material which is folded such that the height of the edges and the spacing between two adjacent edges increase in the direction of the expanding mixing element, that is the mixing element made in the manner of a diffuser. In this connection, edges of adjacent layers come to lie on one another so that a linear contact of adjacent layers along the common edge takes place. A flow passage is formed by this construction whose cross-section increases continuously from the inlet opening to the outlet opening if the whole diffuser cross-section should be covered. The layers can be made up of at least two sectional surfaces which are planar and/or follow the curvature of the edges and/or the profile surfaces themselves have an additional structuring which is in particular made as wave-like or jagged ribs or lamellae and can include a series of open passages which extend between the ribs or lamellae. A structuring of this type is disclosed, for example, in CH 547 120.

It is also possible, in accordance with a further embodiment, to combine layers having a sectional surface with layers having surface-enlarging structures such that one planar layer and one layer having surface-enlarging structures follow one another alternately. Closed passages are hereby created which are bounded by the planar layer, on the one side, and by the layer having the surface-enlarging structure, on the other side.

In a mixing element in accordance with a preferred embodiment, the flow passages of adjacent layers are made to openly cross one another and/or in the manner of a diffuser. A particularly fast and good mixing of the components to be mixed is achieved by this arrangement. In accordance with a further variant, provision can be made for a better mixing for no linear contact of two adjacent layers having surface-enlarging structures to occur, but rather for the edges of the adjacent layers only to contact one another at points. This point-like contact is achieved in that two adjacent layers are arranged at an angle to one another. It is thereby brought about that the edge which belongs to a first layer only has a point-like contact with a number of corresponding edges of the adjacent layer. The substantial advantage of this embodiment lies in the fact that the flowing medium does not always flow in the same passage, as with the previously shown variants, but is rather in a different passage at each time, that is continuously changes the passage. In this case, the flowing medium is deflected substantially more pronouncedly than in the preceding embodiments, which results in an additional improvement in the mixing. Alternatively to this, two adjacent layers having different sections, which are likewise arranged at an angle towards one another between 0 and 180° for the improvement of the mixing, can also be combined with one another.

In accordance with a further embodiment, each layer forms a hollow body having surface-enlarging structures, but is in particular made with a ribbed, jagged or wavy surface. The edges of the surface-enlarging structures accordingly form an interface which can be conceived as a hollow body which in particular has a conical shape. The surface-enlarging structures are inclined towards the direction of flow at an angle of 0 to 180°. A plurality of hollow bodies of this type can be plugged into one another. The angles of the surface-enlarging structures advantageously differ from two adjacent layers formed as hollow bodies so that the flow can be deflected a plurality of times over the surface-enlarging structures.

A flow passage is bordered by at least two sectional surfaces, with two respective sectional surfaces of one layer forming a common edge. Flow passages having planar sectional surfaces can in particular be manufactured cost-effectively and simply. An interface is formed by the edges of a layer which is made in planar form and/or at least sectionally conically. If a layer has a plurality of edges which together form an interface of this type, a planar or conical interface can, for example, be manufactured easily by means of planar sectional surfaces since the planar sectional surfaces can be produced with tight tolerances since the required dimensions can be set and checked in a simple manner. The shape of the interface in particular becomes important when a plurality of layers which are arranged over one another and in which the edges of adjacent layers contact one another at least at points, are required for the manufacture of a mixing element.

In a mixing element, an interface is formed by the edges of a layer which is made in planar form and/or at least sectionally conically. In this connection, the connection surfaces of all edges are called an interface. Most of the aforesaid embodiments for layers with surface-enlarging structures have planar interfaces so that adjacent layers each have one of these planar interfaces in common. In a layer without a surface-enlarging structure, the interface coincides with the surface of the layer.

In accordance with a further embodiment, the interface can also represent a surface curved in any desired manner in space. With a layer having a surface-enlarging structure, the edges of the surface-enlarging structures likewise form a surface curved in space. The use of a layer having a conical interface, so that the layers have interfaces which are formed conically between the layers, is suitable for a static mixer having a conical expansion of the fluid conducting means.

In accordance with a preferred embodiment, the edges belonging to one layer of a mixing element can be made inclined to one another by an angle alpha in a range from 0 to 120°, in particular from 60 to 90°. Intersecting edges of adjacent layers advantageously include opposite and, equal, angles alpha/2 with the main direction of flow.

The cross-section of the mixing element expands from the first cross-section to the second cross-section, in particular in a conical manner, with the diameter of the outlet cross-section in particular enlarging with respect to the diameter of the inlet cross-section by a factor of 2 to 5, which is equal to a cross-sectional enlargement by a factor of 4 up to a factor of 25. In an advantageous embodiment, the mixing element expands conically from the first cross-section to the second cross-section; the diameter of the inlet cross-section in particular expands by a factor of 2 to 5. Since the fluid-conducting means also expands conically in this embodiment, an abrupt transition from one cross-section of an inlet line which opens into the inlet opening, that is usually a tubular line, to the cross-section of the outlet opening is avoided. The outlet opening can be made as an inlet opening into a heat exchanger or reactor. The mixture should enter largely homogeneously into this reactor. Gaseous, liquid and/or solid components of the mixture are in particular held in suspension. The mixing state is maintained by means of the mixing element or elements in a cone—which would otherwise contribute to the demixing as a diffuser. In most cases, an improvement of the mixing of the components is even achieved, in particular by means of mixing elements having crossing flow passages, so that the components can be distributed homogeneously over each cross-section of the cone downstream of the inlet cross-section. The conical shape furthermore provides considerable advantages for the installation of layers since the conical shape of the fluid-conducting means acts as a centering means for the installation of a conical mixing element. Since the mixing element is fitted into a conical fluid-conducting means, only a minimal welding effort is required for the installation. The mixing elements are advantageously made in the manner of a diffuser, that is the mixing elements adapt to the expanding cross-section, that is in particular themselves have a conical shape. The fitting takes place on the basis of the conical shape of the mixing element by the positioning of the mixing element or elements in the cone, whereby the position of the mixing element in the conical fluid-conducting means is clearly fixed.

The layers should, where possible, be directly adjacent to the fluid-conducting means, that is the inner wall of the mixer. With a linear contact, conical sections, that is, in dependence on the inclination of the layer to the cone, elliptical, parabolic or hyperbolic boundary lines result as the sectional curves of a planar layer or of a layer having a surface-enlarging structure, in particular a surface-enlarging structure composed of planar segments, such as a zig-zag structure, having a conical inner wall. Each of the layers described above cant be developed in one plane; a development can therefore be generated by means of drawing programs from the designed position of the layer in the mixer. These developments also include the bending lines in addition to the boundary lines of the layer so that an economical manufacture of the layers is also possible in cases in which each angle is different and very complex bending procedures are therefore necessary.

A possible method for the manufacture of the mixer includes the following steps: manufacturing a fluid-conducting means having an inlet opening with a first cross-section and an outlet opening with a second cross-section, with the fluid-conducting means having a cross-sectional form which increases continuously from the first cross-section to the second cross-section. The mixing element is made in a further step.

The mixing element includes a plurality of layers which are prefabricated individually and are joined together to form a mixing element by means of connection elements. When the surface structures of the layers can be developed in one plane, the manufacture is simplified since the development of each layer from planar, plate-shaped base material can be cut out by means of cutting means and can then be folded by means of bending means for the production of the surface structure. This manufacture is in particular suitable for layers of a metallic material. Layers of plastic are manufactured in their folded form in an extrusion process or in an injection moulding process and are subsequently cut to the shape which is required for the forming of an expanding mixing element, that is in particular of a conical mixing element. In a next step, the layers joined together to form a mixing element are positioned in the mixer.

If the mixing element is fitted into a conical fluid-conducting means in the already assembled state, only a minimal welding effort is required. In a conical mixer, a centration of the layers takes place through the cone so that the assembly of the layers folded from the developments can also take place directly into the fluid-conducting means since the positioning of the layers takes place through the conical shape of the fluid-conducting means itself, the alignment of the layers with respect to one another is predetermined. Alternatively to this, the whole mixing element can also be manufactured in an injection moulding process or in a lost mould.

If the design of the layers corresponding to the cross-passage structure is used, it is possible that dead spaces arise because the layer at the inlet cross-section flow paths are blocked by the angular alignment of the part of the layer which is adjacent to the inner wall. For this reason, the passages on the housing side are checked, and opened when necessary, after production. The wall gap between the mixing elements and the inner wall of the housing amounts to no more than 2% of the respective cross-section, in particular no more than 1% of the respective cross-section, particularly preferably no more than 0.5% of the respective cross-section, so that a so-called "channelling effect" demonstrably does not occur.

The wall gap to the fluid-conducting means should be made to be smaller than the normal spacing of two adjacent interfaces, in particular than the height of a flow passage of a surface-enlarging structure. The height of the flow passage is defined as the normal spacing between the two interfaces formed by the edges of the surface-enlarging structure. The wall gap should in particular amount to a maximum of half the height of the flow passage.

With light demixing phenomena in the region of the inlet opening, the liquid phase can again be guided into the center via a so-called "riser plate" and can be distributed over the cross-section in the mixer. In this connection, a "riser plate" is defined as an installation element which is fastened to the inner side of the fluid-conducting means, is in particular welded to the inner side of the fluid-conducting means. This installation element serves to guide back into a mixing element components which have collected at the deepest point of the fluid-conducting means. Installation element, in this connection, is intended to be representative for specific embodiments such as a section, a ramp, a plate or the like.

In addition to a good distribution effect and/or mixing effect, only a small pressure loss is generated in accordance with each of the aforesaid solutions.

In an advantageous arrangement, mixing elements installed in a tube section of constant cross-section and mixing elements in accordance with any one of the preceding embodiments can be combined with one another. To achieve an improved mixing effect, a conventional mixing element is located in a tube section before the inlet into the static mixer having a fluid-conducting means with an expanding cross-section. In accordance with each of the preceding embodiments, two adjacent mixing elements can be arranged rotated with respect to one another at an angle between 0 and 90°, in particular between 60 and 90°. A further deflection of the flow can be achieved by the rotation, which has in particular proved to be advantageous for the named embodiments with an at least sectional passage-flow.

The arrangement of a mixing element can take place upstream of a heat exchanger, in particular in the inlet region of a heat exchanger. With the expanding mixing element, the flow is distributed uniformly over the expanding cross-section on an enlargement of the average cross-section in the direction of flow and a homogeneity of the flow is ensured over the total cross-section.

The use of the mixing element takes place in a method for the denitrification of emissions, for the distribution of emissions over a catalyst surface, in a method for the manufacture of LNG (liquid natural gas), in particular for the introduction of a gas-liquid mixture such as a refrigerant for LNG gas processing into a heat exchanging apparatus. The heat exchanging apparatus can in particular be a heat exchanger, advantageously a tube bundle heat exchanger.

Liquid carbamide is evaporated and mixed with the gas flow for the denitrification of emissions. Both the evaporation and the mixing can take place simultaneously in the static mixer. Due to the combined process management, it is already necessary to supply the carbamide/gas mixture for further processing to the following process step in the mixed state. A further application possibility consists of evaporating and simultaneously mixing liquids in a static mixer having an expanding cross-section. The use of a mixer of this type is in particular of advantage in plants having low available space in order to obtain a mixture on expansion to larger diameters in the mixed state.

Coolant must be cooled for the further use for natural gas processing. The coolant consists of different gaseous and liquid components, with the larger part including methane and ethane. The mixture of gaseous and liquid coolant is usually guided in a tube line to a heat exchanger, in particular to a tube bundle heat exchanger, where it is then cooled via a multipass system. The inlet of the tube bundle heat exchanger as a rule has a size of DN1500 to DN2400 (1.5 to 2.4 m), which means that the mixture has to be expanded from substantially DN600 (0.6 m) via a cone into the inlet of the tube bundle heat exchanger. So that the heat exchanger can achieve its full capacity, the gaseous and liquid components must be uniformly mixed over the cross-section and be supplied to the individual tubes in equal portions. The heat exchanger is substantially designed for gas/liquid mixtures, that is the gas/liquid mixture should have a uniform distribution over the inlet cross-section into the heat exchanger.

A further possible application of the mixing element in automotive construction relates to the inlet of an engine exhaust gas into a catalytic converter for the catalytic separation of pollutants, in particular nitrogen oxides (NOx) and the binding thereof by catalytic reaction at the catalyst surface. Since the available space for a static mixture in an exhaust is relatively small in vehicles, in particular in trucks, static mixers having the above-described expanding cross-section are of great advantage for such purposes since no additional construction space is required. The problem of the demixing of exhaust gas and liquid and/or solid components also occurs in an exhaust system in which the emissions open from a relatively small exhaust pipe into a larger catalytic converter housing. So that the catalyst is not worn unilaterally, a complete evaporation and simultaneously a good homogenisation is required which can be achieved using a static mixer in accordance with one of the aforesaid embodiments with low pressure losses.

A further possible use of the mixing element in accordance with one of the preceding embodiments is the chemical reaction technology for the carrying out of catalytic and/or biogenic reactions, in particular with expanding cross-sections for the inlet of a monophase or multiphase fluid mixture into a reactor. Gaseous and liquid components often have to be dispersed before a reactor. After generation of the bubble bed and the uniform distribution of the components, the flow is often expanded because the flow enters into a reactor containing a catalyst with a diameter which is enlarged with respect to the line diameter. The static mixer is used to maintain the homogeneity of the mixture. The lower braking effect in the static mixer in comparison with an abrupt cross-sectional transition from the infeed to the inlet cross-section into the reactor container contributes to allowing the bubbles to coalesce less quickly.

A further use of the static mixer is in the field of gas liquefaction. In gas liquefaction, different gas flows are mixed and then guided into a multi-tube system. In a designated application, the gas is mixed in a tube of DN 600 (0.6 m) and should then be split uniformly into the different tubes in a housing diameter of DN 12000 (12 m). In the prior art known at the time of the application, baffles are used for this purpose. So that each tube receives the same gas portion, the use of a static mixer in accordance with one of the preceding embodiments is possible.

A further area of application for the static mixer is in the field of reactors in which a piston flow should be maintained so-called plug-flow reactors. In plug-flow reactors, mixing elements ensure that the fluid is guided through a cylindrical housing in a piston flow. If the diameter has to be changed, the piston flow is disturbed in the conical section due to the lack of mixing elements. The flow properties in the conical section can be maintained with the use of conical mixing elements.

As mentioned above, a static mixer of the aforesaid construction type can also be combined with a static mixer which works as a pre-mixer and has a constant cross-sectional development, in particular a hollow cylindrical cross-sectional development. The mixing of the individual fluid components takes place in the static mixer of cylindrical construction; the static mixer with expanding cross-section primarily has the function of expanding and/or distributing the mixture uniformly.

To reduce pressure losses, it is also possible to provide intervals between individual mixing elements in which flow relationships prevail as in a tube line. Short distances between the individual conical mixing elements do not effect any noticeable demixing, but do serve to split the flow again without additional pressure loss.

The invention will be explained in the following with reference to the drawings wherein.

Figure 4A:
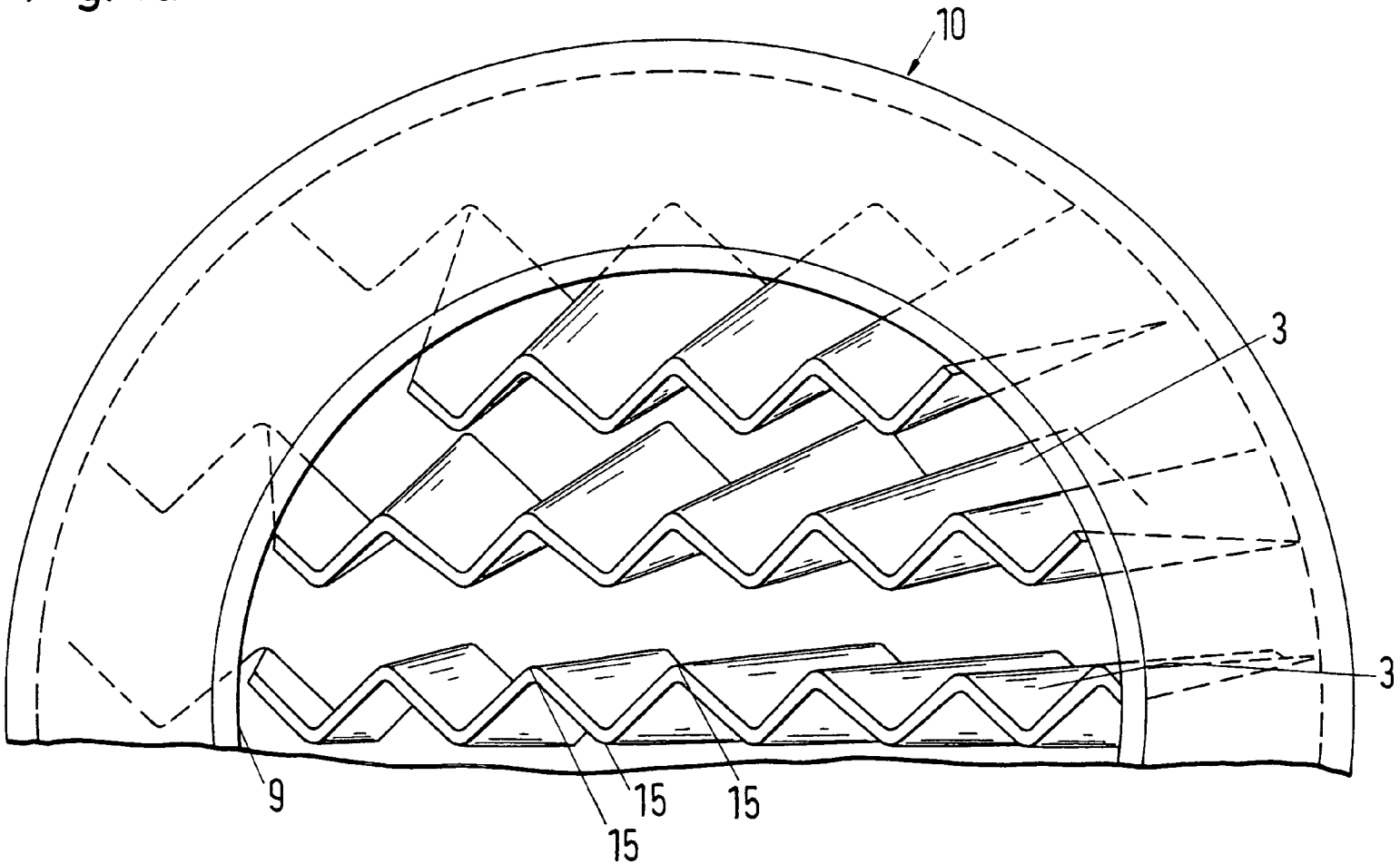
Figure 4B:
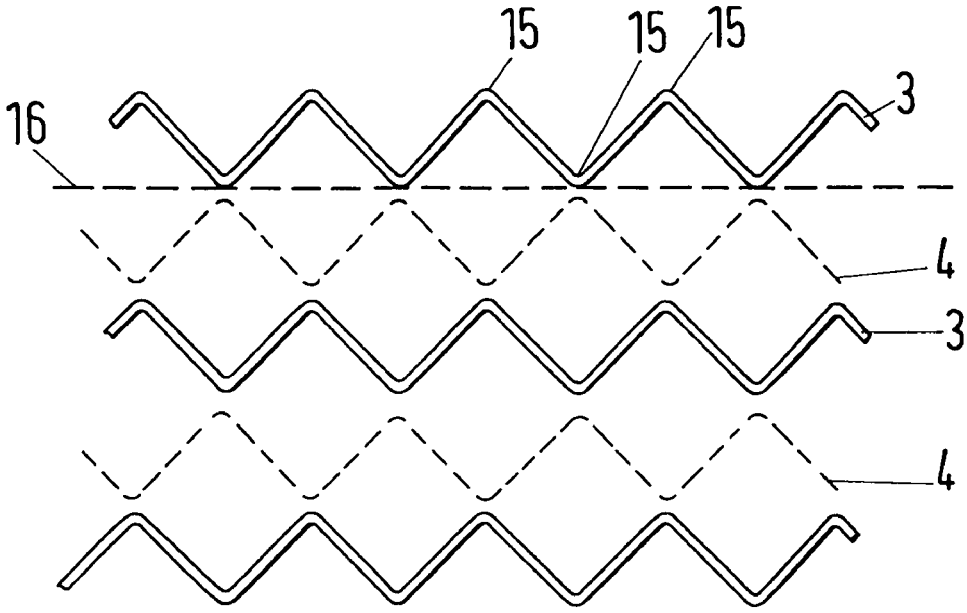
Figure 4C:
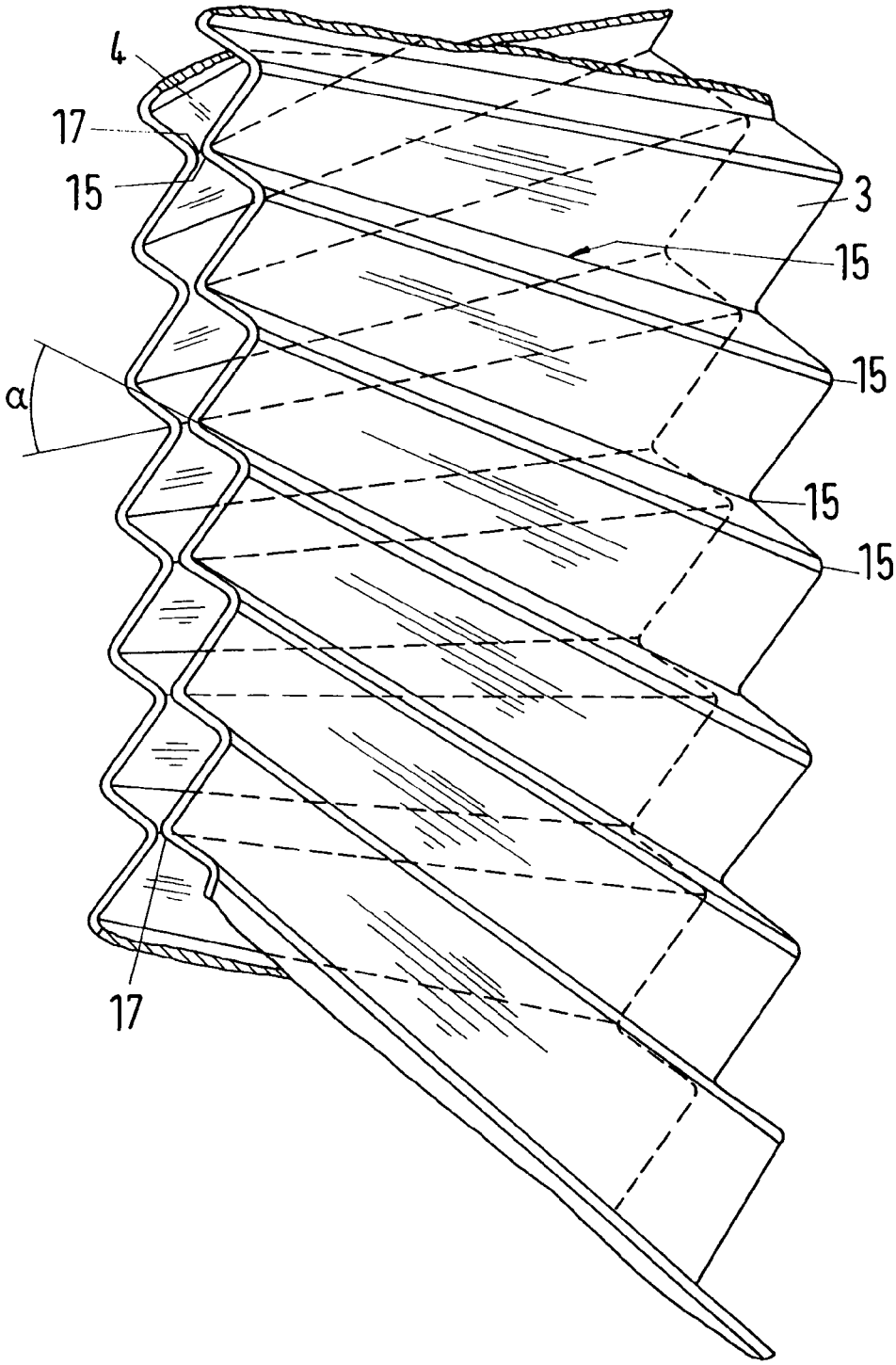
Figure 5A:
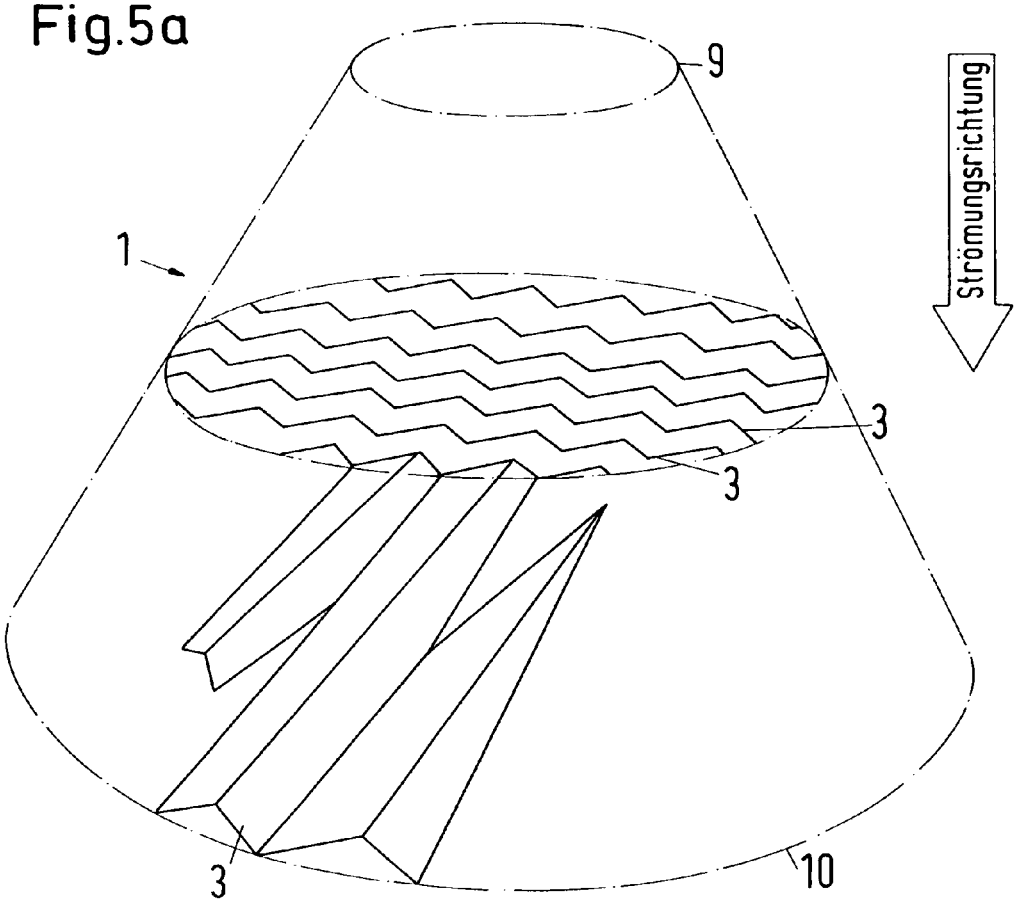
Figure 5B:
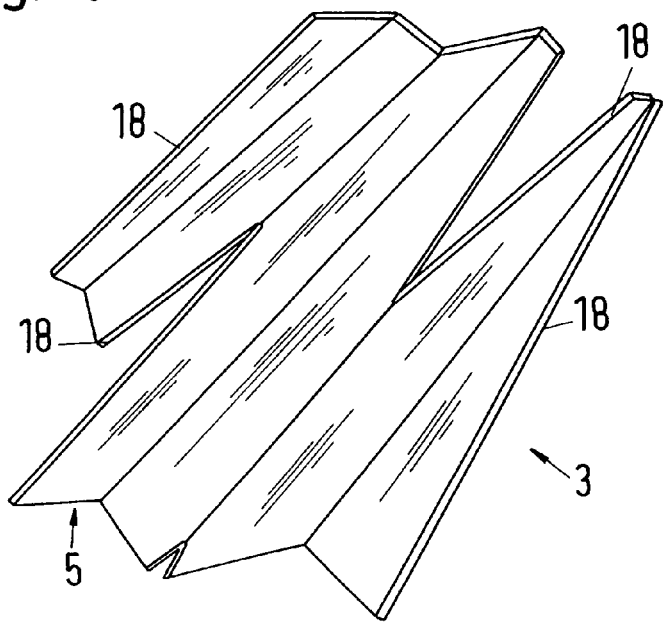
Figure 6A:
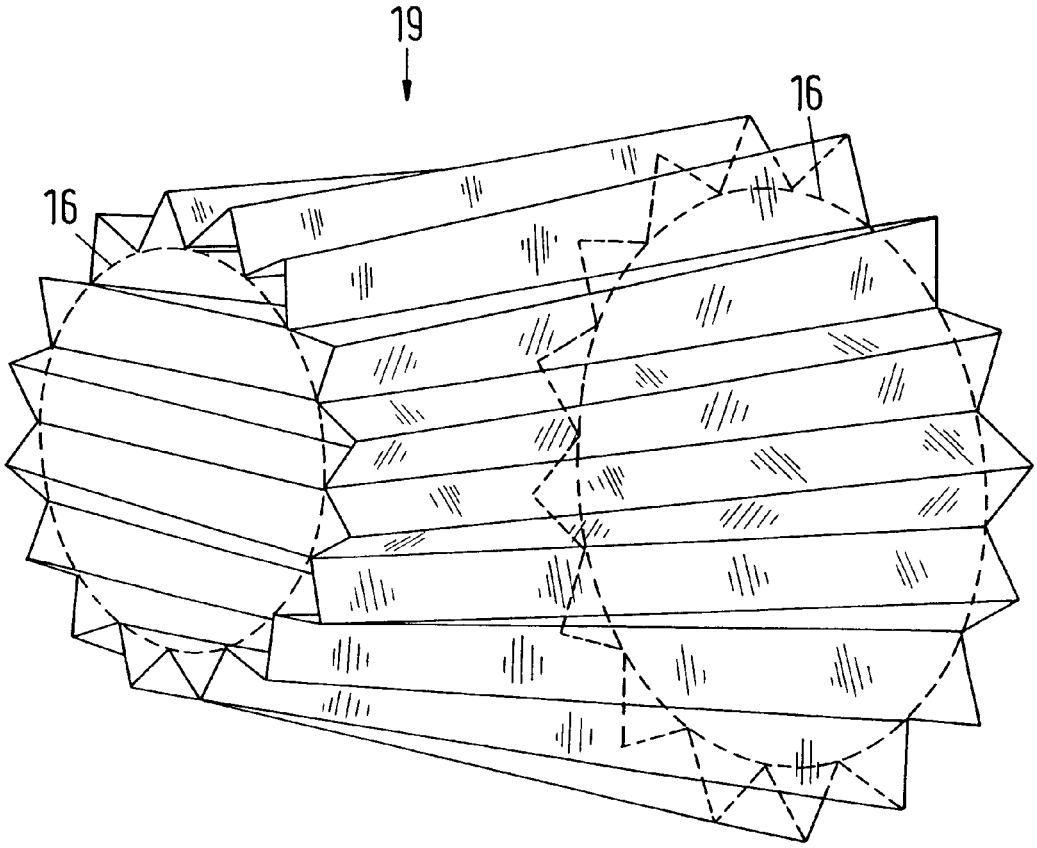
Figure 6B:
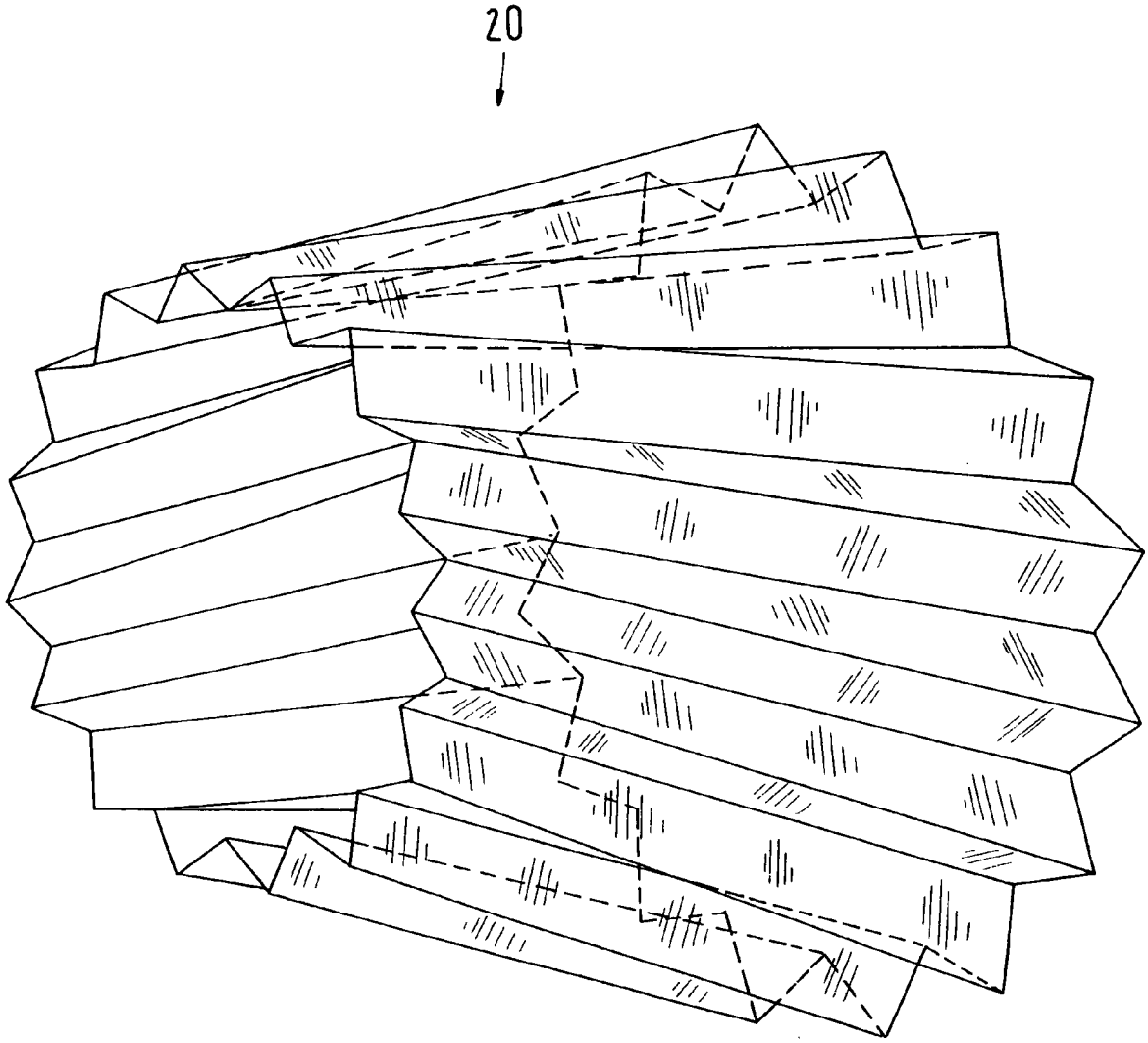
Figure 7:
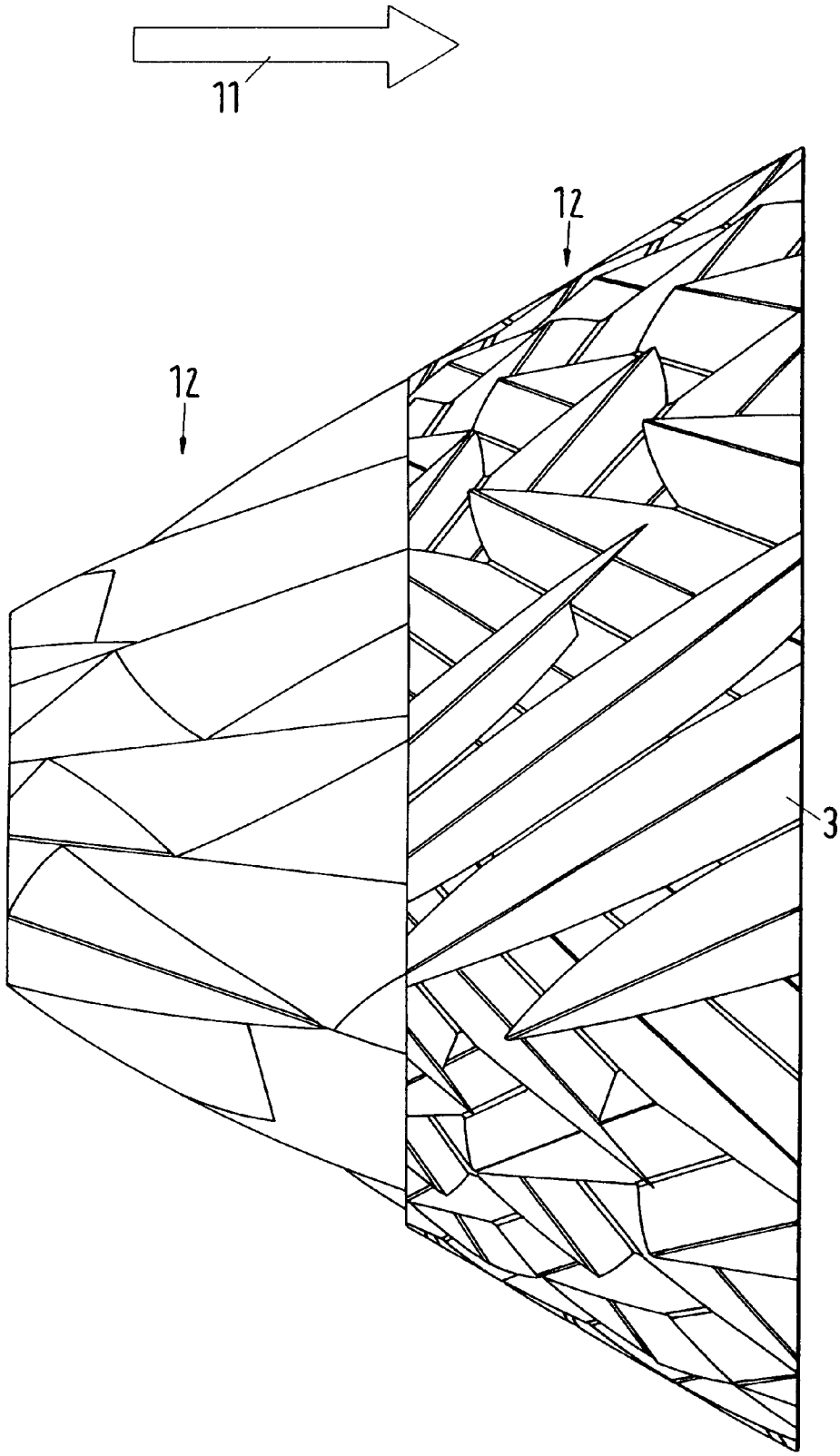
Figure 8A:
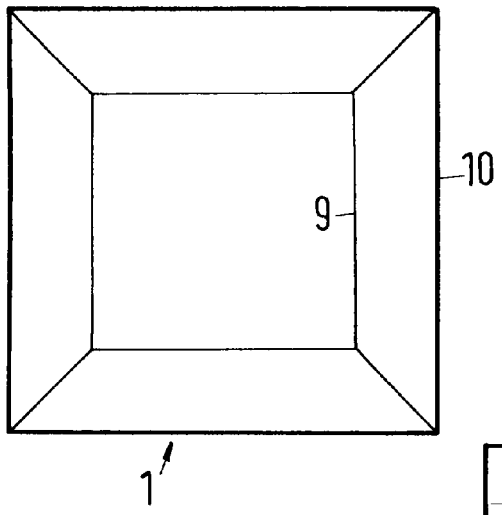
Figure 8B:
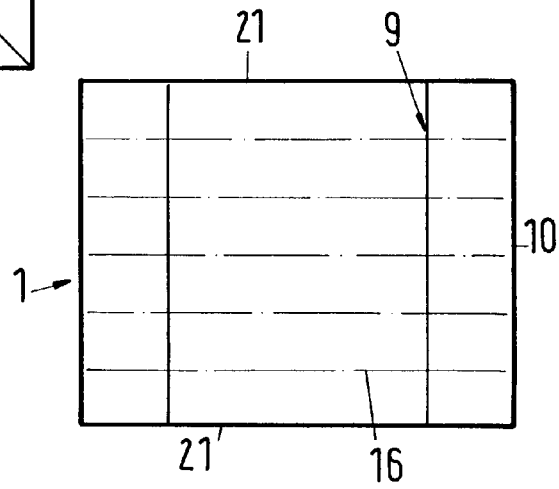
Figure 8C:
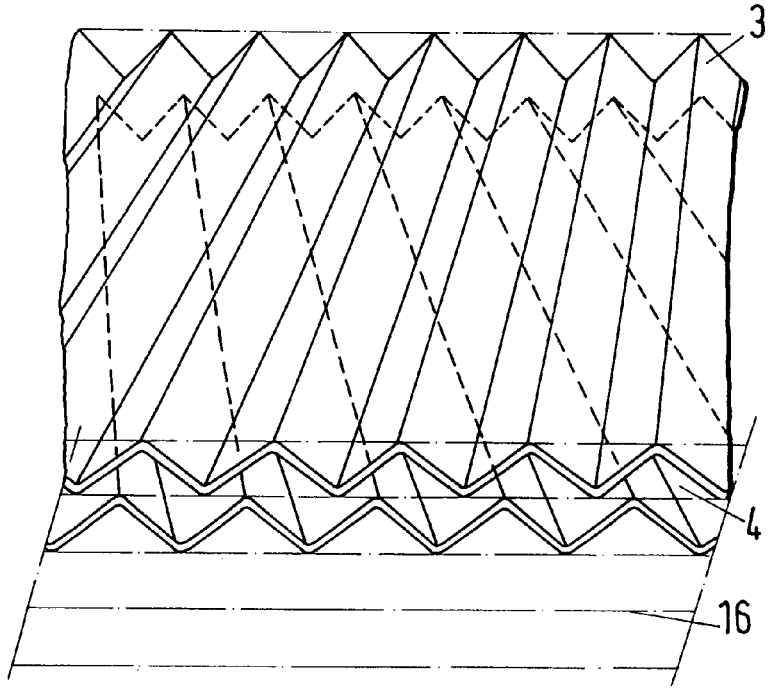

FIG. 4*a* illustrates the installation of layers with a zig-zag section in a conical mixer housing;

FIG. 4*b* illustrates a section through a series of layers with a zig-zag section;

FIG. 4*c* illustrates two crossing layers with a zig-zag section;

FIG. 5*a* illustrates a first layer with a zig-zag section which forms a conical hollow body;

FIG. 5*b* illustrates a second layer with a zig-zag section which forms a conical hollow body;

FIG. 6*a* illustrates the installation of a layer with a zig-zag section into a conical mixer housing;

FIG. 6*b* illustrates a marginal layer with a zig-zag section inclined relative to the main direction of flow;

FIG. 7 illustrates an arrangement of two mixing elements for a conical static mixer;

FIG. 8*a* illustrates a fluid-conducting means with a square cross section;

FIG. 8*b* illustrates a fluid-conducting means with a rectangular cross-section; and FIG. 8*c* illustrates two adjacent layers of a mixing element with openly crossing flow passages.

Figure 1:
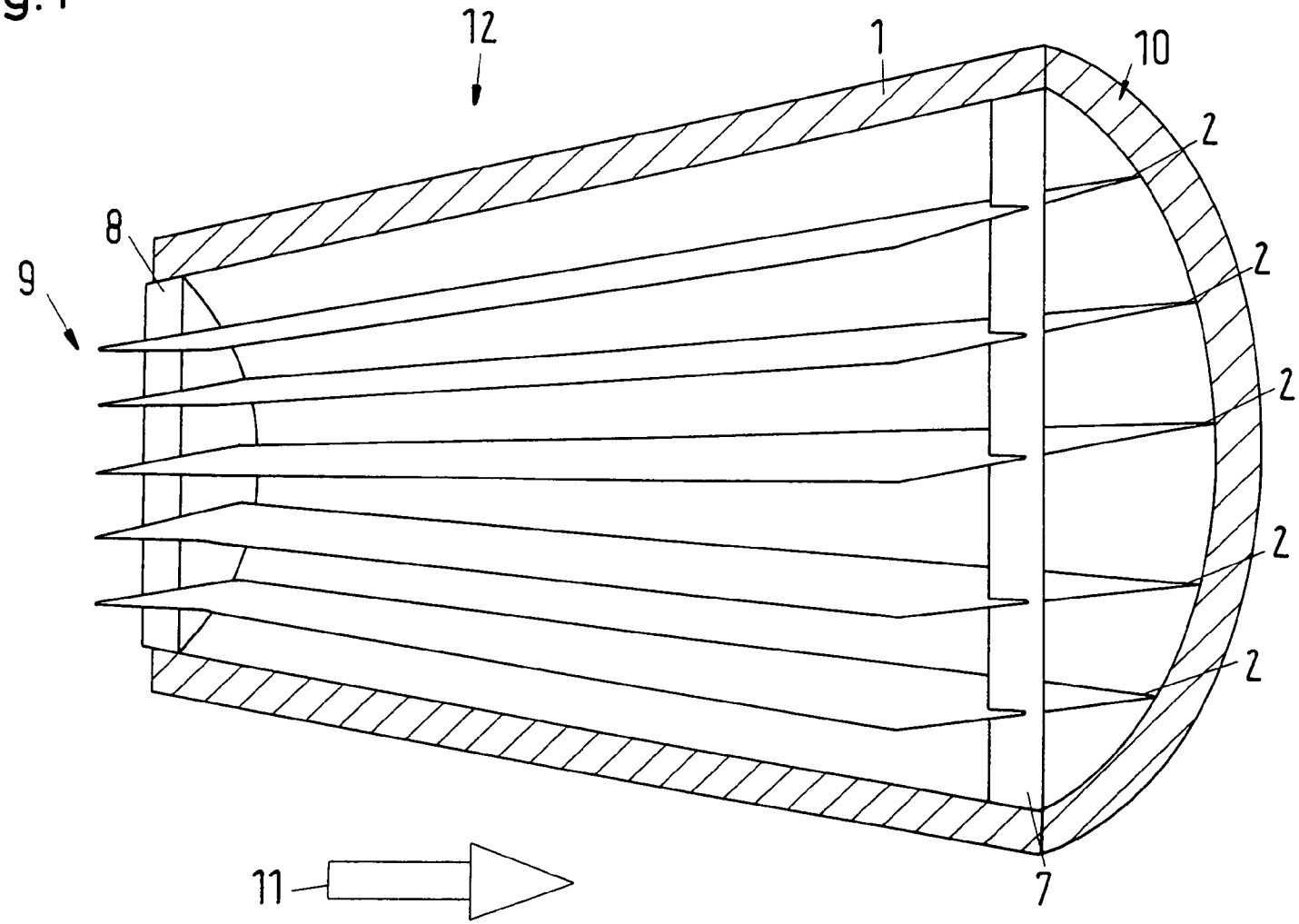
FIG. 1 illustrates a part perspective view of a static mixer employing a first embodiment of a mixing element of planar layers in accordance with the invention.

Referring to FIG. 1, the static mixer includes a fluid-conducting means or housing 1 having a conical shape with an inlet opening 9 at one end having a first cross-section which is arranged in a plane disposed substantially normal to the main direction of flow 11 in the inlet opening 9 and an outlet opening 10 at the opposite end having a second larger cross-section which is arranged in a plane disposed substantially normal to the main direction of flow 11 in the outlet opening 10.

The static mixer also includes a mixing element 12 within the housing 1. This mixing element 12 includes a number of trapezoidal installations or layers 2, each with a planar surface. However, each layer 2 may be provided with any desired surface-enlarging structures in accordance with one of the previously mentioned embodiments. In the conFIG. uration shown, a flow of a fluid mixture is guided into the region between the layers 2 from the inlet cross-section 9 to the outlet cross-section 10, with the arrow 11 indicating the main direction of flow.

The fluid mixture should in particular be understood as a gas/liquid mixture or a mixture of gases or a mixture of liquids. Each of the phases can additionally include a solid portion.

The flow is uniformly expanded and distributed by the alignment of the layers 2 matched to the shape of the fluid-conducting means 1. The number and the spacing of the layers 2 essentially depend on the mixing effect in each layer 2. This is, in turn, influenced by the flow speed and, not least, by the properties of the flowing components such as in particular their density or viscosity. Frictional effects can occur at each of the walls of the layers 2 and of the housing 1 so that the marginal flows arise which result in a lower throughput in marginal regions and wall regions because the flow close to the wall has a lower speed than the main flow due to the frictional effects.

In the example shown, the layers 2 are held together at intervals by holding devices 7, 8. In accordance with another embodiment (not shown), the layers can also be fastened to the inner wall of the actual fluid-conducting means by means of plug connections or clamp connections. The installation of layers into a conically designed fluid-conducting means can take place such that the layers are assembled with the holding devices in advance and are then inserted into the housing as a prefabricated mixing element 12. The conical shape of the housing 1 thus also effects the centering of the mixing element 12 prefabricated in this way.

Figure 2:
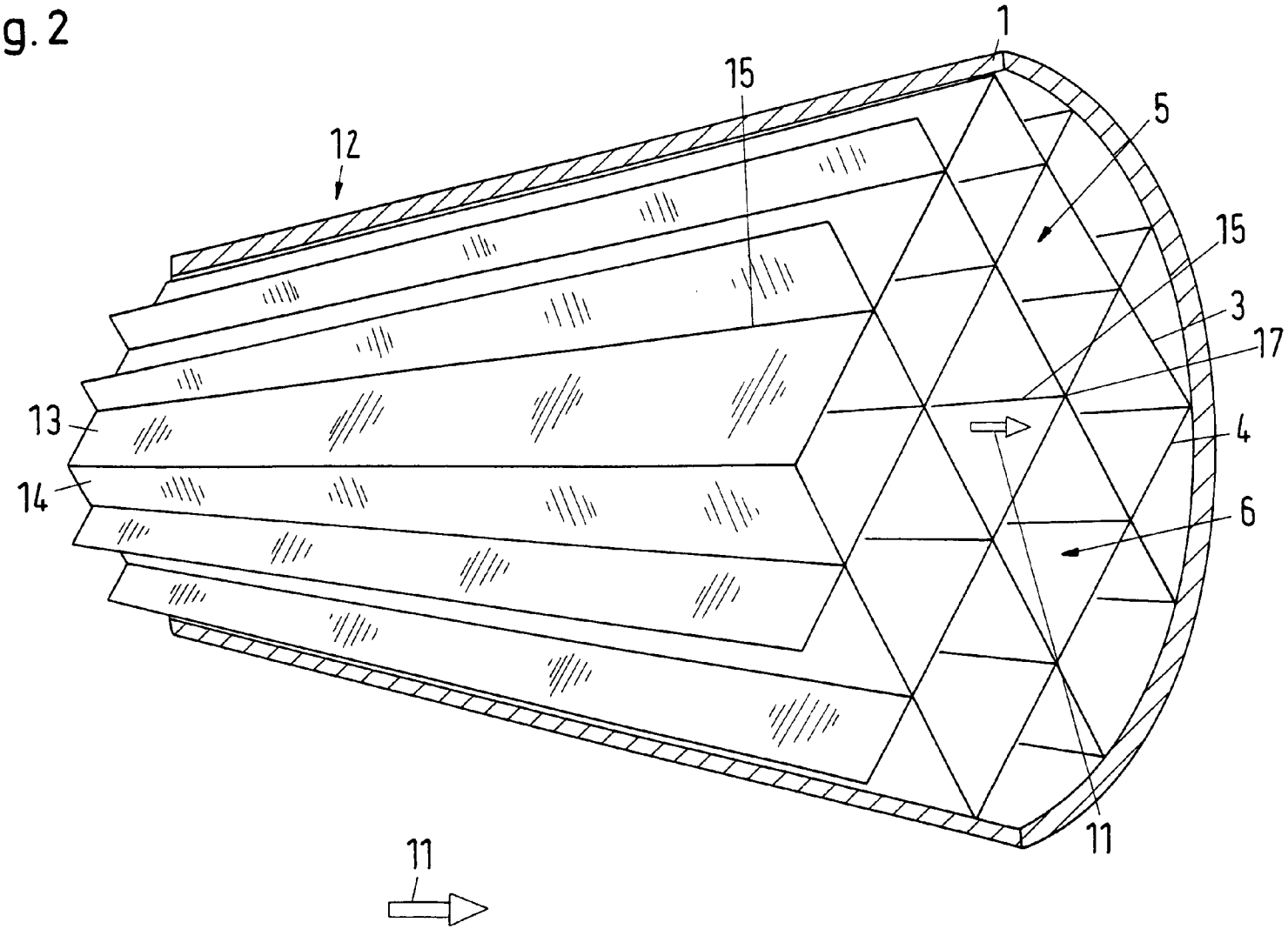
FIG. 2 illustrates a part perspective view of a static mixer employing a second embodiment of a mixing element of layers with a zig-zag section in accordance with the invention.

Referring to FIG. 2, in another embodiment, a mixing element is comprised of layers with a zig-zag section (only two such layers 3, 4 are shown for reasons of clarity). The flowing mixture is guided through the layers which form V-shaped flow passages. In the case shown, the layer 3 is supported along the common edges 15 on the layer 4. One edge 15 belongs to the layer 4 and faces normally to the main direction of flow, shown by arrow 11 in the direction of the fluid-conducting means shown as an upper housing wall. One edge 15 belongs to the layer 3 and is thus in linear contact with the edge 15 of the layer 4. The sectional surfaces 13, 14 of the zig-zag section forming the respective layer run together at the edges and form a flow passage through which the components to be mixed flow. The flow passage is thus bounded by the sectional surfaces 13, 14. When the edges of adjacent layers contact one another over the total length between the inlet cross-section 9 and the outlet cross-section 10, flow passages are formed which are closed by adjacent layers and which are made up of two respective open flow passages 5, 6. A flow passage closed in this manner has a substantially diamond-shaped cross-section. For reasons of simplified installation or improved mixing of the individual part flows, it is possible to provide a spacing between the layers 3, 4 —in an analogous manner as shown in FIG. 1. The edges 15 of the two adjacent layers arranged over one another then no longer contact one another so that a common edge 15 is no longer formed. An open flow passage is then formed by the sectional surfaces 13, 14.

The fastening of the layers 3, 4 as well as of further layers not shown in FIG. 2 for the forming of a mixing element can take place by means of the same fastening means as shown in FIG. 1, with the possibility also being present of provided a weld connection, in particular a spot-weld connection and/or a solder connection and/or an adhesive bond connection or the like.

Additional possibilities of the flow deflection and of the improvement of mixing result in that the passages are provided with flow-deflection means which are not shown. Perforated metal sheets, projections in the passage walls, tabs or surface-enlarged structures inserted into the flow passages and distributed in the manner of bulk material are in particular provided for this purpose. Structures of this type are used in gas/liquid absorption and as column installations, in particular Raschig rings, Berl saddles, Intalox saddles, Pall rings, Tellerette structures. Another possibility is to provide the layer itself with flow-deflecting structures, in particular with a structure which is comparable with a stretching metal, as well as with one of the structures already mentioned in the general description of the mixing element.

Figure 3:
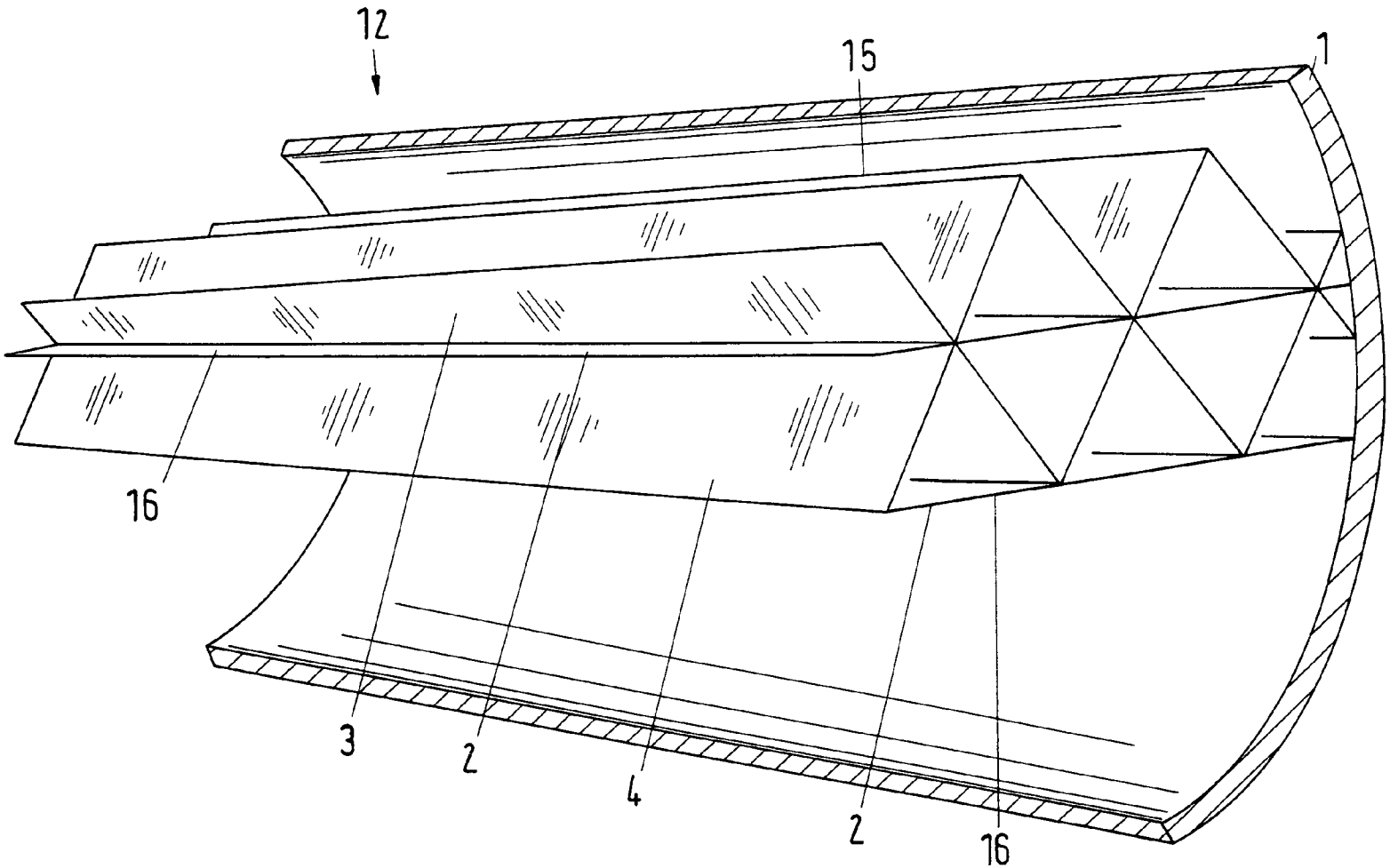
FIG. 3 illustrates a third embodiment of a static mixer employing a mixing element of a combination of planar layers and layers with a zig-zag section.

Referring to FIG. 3, third embodiment of a mixing element includes a combination of planar layers 2 and layers 3,4 with sectional surfaces 13, 14, in particular with a zig-zag section. The representation of further layers has been omitted for reasons of clarity. Instead of the planar layer 2, a layer with sectional surfaces can also be used which differ from sectional surfaces with a zig-zag section. Closed flow passages are formed by the layer 4 and by the two layers 2. The edge 15 of the layer 4 contacts the layer 2, but not the edge 15 of the layer 3. The flow passages thus have a substantially triangular cross-section. Analogously to the expanding cross-section of the mixing element, the cross-section of the flow passages formed by the adjacent layers 2, 3, 4 increases continuously in the main direction of flow. The advantage of a mixing element having layers forming flow passages is their low pressure loss and their contribution to the generation and/or maintenance of a homogeneous mixture with a simple constructional design. The flowing medium has to follow the course of the flow path predetermined by the fluid-conducting means; the composition of the flowing mixture therefore remains constant through the flow passage due to the continuity principle as long as no chemical reaction takes place in the static mixer. The flow is only in the fluid-conducting means for a short period since the fluid-conducting means usually only serves as a transition from a first cross-section of smaller diameter to a second cross-section of larger diameter. The path is therefore too short for real demixing effects to become noticeable along the flow passages in flowing through the fluid-conducting means. All part flows are guided together in the outlet cross-section 10, which generally coincides with an end of a flow passage.

At high flow speeds, eddies can be released in accordance with the principle of Karman's eddy path at the ends of the flow passages lying in the plane of the outlet cross-section, whereby the mixing can be improved even more.

In accordance with a further advantageous embodiment in accordance with FIG. 4*a*, provision can be made for the better mixing that no linear contact of two adjacent edges 15 occurs in accordance with FIG. 2 or of one each of the edges 15 with the layer 2 arranged therebetween in accordance with FIG. 3, but that two crossing adjacent layers 3, 4 with a zig-zag section are provided as are shown by way of example in FIG. 4*c* in which the edges 15 only contact one another at one point. This point-like contact takes place at the contact point 17 for the edges 15 and it is thereby achieved that two adjacent layers 3, 4 are arranged at an angle to one another. It is thereby effected that the edge 15, which belongs to a first layer 3, only has one contact point 17 with the edge 15 of the layer 4. The angle alpha between two edges 15 of adjacent layers lies between 0° and 120°, in particular between 60° and 90°. In a particularly advantageous embodiment, one edge 15 of the layer 3 is inclined by alpha/2 with respect to one side; one edge of the adjacent layer 4 is inclined by alpha/2 with respect to the other side in relation to the main direction of flow. This arrangement produces the "cross-passage structure" mentioned later as is described in CH 547 120. The edges of the layer 3 in the embodiment of FIG. 4*a*, 4*b* or 4*c* form a plane which is called the interface 16 of the layer (see FIG. 4*b*). The interface 16 contains all the contact points of adjacent layers when adjacent layers are arranged such that they form a common interface. The substantial advantage of this arrangement, also known as a cross-passage structure, in accordance with this embodiment is found in the fact that the flowing mixture does not always flow in the same flow passage as in the previously shown variants, but is located in another flow passage at every time, that is continuously changes the flow passage. In this case, the flowing mixture is deflected substantially more pronouncedly than in the preceding embodiments, which results in an additional improvement in the mixing.

The fitting of layers 3, 4 with a zig-zag section and planar interfaces is shown in FIG. 4*a*, with only every second layer 3 being shown, whereas the adjacent layers 4 have been omitted to increase the clarity of the representation. The layers have been made such that the shortest possible spacing of two adjacent edges, measured in a cross-section normal to the main direction of flow, increases continuously from the inlet cross-section 9 to the outlet cross-section 10. It is equally possible for the normal spacing between two adjacent interfaces 16, measured in a cross-section normal to the main direction of flow, to increase continuously from the inlet cross-section 9 to the outlet cross-section 10, or also to be kept constant, whereby the interfaces of the layers come to lie parallel to one another.

In accordance with the embodiment shown in FIG. 4*a*, adjacent interfaces are expanded in the manner of a diffuser from the inlet cross-section 9 to the outlet cross-section 10.

At least some of these contact points 17 can be made as weld spots to join adjacent layers 3, 4 together to form a mixing element.

In accordance with a further variant, the interfaces 16 of adjacent edges 3, 4 do not coincide, but rather have a small spacing from one another so that adjacent layers do not contact one another. Some of the flowing mixture is not completely deflected by this measure so that the flow is slowed down less. The effects on the mixing are dependent on the components to be mixed, the proportions of the different phases and on the tendency to demixing. The pressure loss of the static mixer is also influenced by the change in the spacing of the layers.

Where possible, the layers should directly adjoin the inner wall of the fluid-conducting means, as is indicated in FIG. 4*a*, so that at most a small spacing remains between the layer 3 and the inner wall.

With a linear contact of the layer 3, conical sections, that is, depending on the inclination of the layer to the inner wall, elliptical, parabolic or hyperbolic boundary lines, result as sectional curves of a layer which is planar or folded in any desired manner and is made up of planar segments and has a conical inner wall, which is shown in FIG. 5*a* and FIG. 5*b*. Each of the layers described above, of which one is shown in FIG. 5*a*, can be developed in one plane; a development can therefore be generated by means of drawing programs from the desired position of the layer in the mixer. These developments also include the bending lines in addition to the boundary lines so that an economical manufacture of the layers is also possible in cases in which each angle is different and very complex bending procedures are therefore necessary.

In FIG. 5*a*, a cross-section through such a cross-passage structure is shown, with only every second layer 3 being shown, as in FIG. 4*a*. If the design of the layers corresponding to the cross-passage structure is used, it is possible that dead spaces arise because the layer at the inlet cross-section 10 flow paths are blocked by the angular alignment of the part of the layer which is adjacent to the inner wall. For this reason, the passages on the housing side, that is on the inner wall, are checked and opened as required after the assembly of the layers to form a mixing element. The wall gap between the mixing elements and the inner wall of the fluid-conducting means 1 is smaller than the normal spacing of two adjacent interfaces 16, in particular smaller than the height of a flow passage 5, 6 of a surface-enlarging structure, in particular of the zig-zag section shown, so that a so-called "channelling effect" demonstrably does not occur.

A layer 3 in the marginal region of the mixing element is shown in FIG. 5*b*. The layer 3 has sectional curves 18 which are adjacent to the inner wall of the fluid-conducting means. If the sectional surfaces (13, 14) of the layers were directly adjacent to the inner wall, no flow would take place through flow passage 5. These sectional surfaces are therefore arranged at least partly at a spacing from the inner wall or are opened for the flow after the assembly of the mixing element.

In accordance with a further embodiment in accordance with FIG. 6*a* and FIG. 6*b*, each layer forms a hollow body 19 having surface-enlarging structures. The surface-enlarging structure of the hollow body 19, in particular the ribs, jags or waves, are inclined at an angle of 0° to 180° relative to the main direction of flow. A plurality of hollow bodies of this type can be made such that they can be plugged into one another. In the present case, the hollow body 19 can be completely integrated into the hollow body 20 in that hollow body 19 is plugged into hollow body 20. In the embodiment shown, the hollow bodies 19, 20 have a zig-zag section. The outwardly directed and also the inwardly directed edges each form an interface which is conical. If hollow body 19 has an excess dimension relative to hollow body 20, which only means that the inner interface of hollow body 20 comes to lie within the outer interface of hollow body 19, the two hollow bodies 19, 20 are canted on installation such that it is possible to completely dispense with an additional fixing of the hollow bodies, such as by weld spots or fastening devices, in the event of forces through the flowing medium onto the hollow body in the installed state of the mixing element. The clamping forces provide sufficient security against a positional change of the layers in operation. If it is possible from the aspect of the place of installation, a mixing element of this type, which has a substantially vertically arranged main axis of flow, can be installed such that the mixture flows through the static mixer from bottom to top. If there is a risk that the layers can become displaced with respect to one another or even carried along through the outlet cross-section by the flow, because they are made of a light material such as a light metal or plastic, a retaining device can optionally be provided in the region of the outlet cross-section 10.

FIG. 7 shows two mixing elements 12 for a conical static mixer which are arranged directly adjacent to one another. These mixing elements are made up of layers 3 which in particular have the zig-zag section in accordance with one of the preceding embodiments, with adjacent layers being inclined with respect to one another by an angle other than 0°. Each mixing element 12 has high stability, because the layers support one another and are supported against the inner wall of the fluid-conducting means. The main direction of flow is shown by the arrow 11.

In accordance with a further variant, not shown, the two mixing elements 12 can also be arranged at a spacing from one another.

In FIG. 8*a*, a fluid-conducting means having a square cross-section is shown. The cross-sectional surface increases continuously from the inlet cross-section 9 to the outlet cross-section 10. In this process, each side length of the square increases continuously.

In FIG. 8*b*, a fluid-conducting means having a rectangular cross-section is shown. The cross-sectional surface increases continuously from the inlet cross-section 9 to the outlet cross-section 10. In this process, only every second side length of the rectangular cross-section increases continuously; in FIG. 8*b* this is the side length 21. In FIG. 8*b*, the interfaces 16 of the layers of the mixing element are indicated.

FIG. 8*c* shows the arrangement of two adjacent layers 3, 4 with a zig-zag section for one of the embodiments shown in FIG. 8*a* or FIG. 8*b*. Further layers are only indicated by their interfaces 16 so as not to make FIG. 8*c* too complex to view. In this variant, no special machining steps are required for the execution of the marginal layers adjacent to the inner wall of the fluid-conducting means 1 so that the manufacturing effort for a mixing element having a fluid-conducting means 1 with sectionally planar jacket surfaces is lower.

Reference is made to the possibilities for zig-zag sections shown under FIGS. 4*a* to 4*c*, which should in turn be exemplary for all other embodiments of the layers mentioned in the text, with respect to the possibilities of the expansion of the passages of the individual layers from the inlet cross-section to the outlet cross-section 10.

The invention provides a static mixer that can be used for various purposes and in various industries. For example, the static mixer may be arranged in the inlet region of a heat exchanger, or used for natural gas processing and/or for emission denitrification, or for the carrying out of catalytic and/or biogenic reactions.

What is claimed is:

1. A static mixer comprising a fluid-conducting means defining a fluid passage having an inlet opening for at least two components having a first cross-section of one of a circular and a polygonal cross-sectional shape in a plane disposed substantially normal to the main direction of flow in said inlet opening and an outlet opening for a mixture of the two components having a second cross-section of one of a circular and a polygonal cross-sectional shape in a plane disposed substantially normal to the main direction of flow in said outlet opening and larger than said first cross-section; and a mixing element in said fluid-conducting means extending completely across said fluid passage and having a plurality of flow-dividing layers comprising openly crossing flow channels extending therethrough and defining a cross-sectional development increasing substantially continuously from said first cross-section to said second cross-section and wherein said flow passages of one of said layers are disposed in crossing relation to said flow passages of an adjacent one of said layers.

2. A static mixer as set forth in claim 1 wherein said fluid passage has one of a circular and a polygonal cross-sectional shape.

3. A static mixer as set forth in claim 1 wherein each said layer includes a plurality of parallel flow passages of widening cross-section in the direction of said outlet opening.

4. A static mixer as set forth in claim 1 wherein each said layer has an edge in contact with an adjacent layer in a common interface plane disposed between said layers.

5. A static mixer as set forth in claim 1 wherein each said layer has a zig-zag cross-section defining a plurality of parallel flow passages and wherein said flow passages of one of said layers are disposed in crossing relation to said flow passages of an adjacent one of said layers by an angle alpha in a range from 60° to 90° and with edges of adjacent layers including angles alpha/2 which are equal and opposite with the main direction of flow.

6. A static mixer as set forth in claim 1 wherein said fluid conducting means has a conically increasing cross-section from said inlet opening to said outlet opening and said mixing element expands conically from said inlet opening to said outlet opening with the diameter of said outlet opening increasing by a factor of 2 to 5 with respect to the diameter of said inlet opening.

7. A static mixer as set forth in claim 1 further comprising a plurality of said mixing elements in said fluid conducting means, each said mixing element being rotated by 60° to 90° with respect to an adjacent mixing element.

8. A mixing element comprising a plurality of flow-dividing layers defining a conical shape and extending from an inlet for at least two components at one end having a first cross-section in a plane disposed substantially normal to the main direction of flow in said inlet to an outlet at an opposite end for a mixture of the two components having a second cross-section in a plane disposed substantially normal to the main direction of flow in said outlet and larger than said first cross-section, said layers extending completely across said first cross-section of said inlet and across said second cross-section of said outlet and comprising openly crossing flow channels and defining a cross-sectional development increasing substantially continuously from said first cross-section to said second cross-section, said layers expanding conically from said inlet opening to said outlet opening.

9. A mixing element as set forth in claim 8 wherein each said layer includes a plurality of parallel flow passages.

10. A mixing element as set forth in claim 8 wherein each said layer includes a plurality of parallel flow passages of widening cross-section in the direction of said outlet opening.

11. A static mixer comprising a fluid-conducting means including an inlet opening for at least two components having a first cross-section of one of a circular and a polygonal cross-sectional shape in a plane disposed substantially normal to the main direction of flow in said inlet opening and an outlet opening for a mixture of the two components having a second cross-section of one of a circular and a polygonal cross-sectional shape in a plane disposed substantially normal to the main direction of flow in said outlet opening and larger than said first cross-section; and a mixing element in said fluid-conducting means having a plurality of flow-dividing layers extending from and across said inlet opening to and across said outlet opening and defining a cross-sectional development increasing continuously from said first cross-section to said second cross-section, each said layer having a zig-zag cross-section defining a plurality of flow channels disposed in openly facing crossing relation to the flow channels of an adjacent layer of said layers.

* * * * *